United States Patent [19]

Kim

[11] Patent Number: 4,461,481

[45] Date of Patent: Jul. 24, 1984

[54] GOLF CLUB OF THE DRIVER TYPE

[76] Inventor: Sunyong P. Kim, 3160 W. 6th St. #635, Los Angeles, Calif. 90020

[21] Appl. No.: 462,354

[22] Filed: Jan. 31, 1983

[51] Int. Cl.[3] ..... A63B 53/08

[52] U.S. Cl. ..... 273/170; 273/167 H

[58] Field of Search ..... 273/170, 171, 162 R, 273/167 H, 186 A, 194 B, 194 A, 194 R

[56] References Cited

U.S. PATENT DOCUMENTS

| | | | |
|---|---|---|---|
| 1,975,307 | 10/1934 | Ackerman | 273/170 |
| 3,589,731 | 6/1971 | Chancellor | 273/170 |
| 4,340,230 | 7/1982 | Churchward | 273/171 |

*Primary Examiner*—George J. Marlo

*Attorney, Agent, or Firm*—John T. Matlago

[57] ABSTRACT

A driver type of golf club is provided which includes a hollow metal head having integrally formed thereon a front striking face and a rear wall with interior flat portions, and a removable sole plate. A rod having a back plate integrally formed on the rear thereof has a cylindrical weight slidably mounted thereon. The rod is fixed in position within said hollow metal head with its back plate anchored against the interior flat portions on the rear wall thereof and with its front end held in an opening provided in a front plate anchored against the back of the striking face. At the instant of impact of the striking face of the head with a golf ball, the cylindrical weight is propelled to freely slide along the fixed rod to hit the front plate on the back of the striking face, and therefore the ball, with a delayed impulse which creates an additional transfer of momentum to the ball thereby increasing the distance that the ball travels.

2 Claims, 5 Drawing Figures

GOLF CLUB OF THE DRIVER TYPE

BACKGROUND AND SUMMARY OF THE INVENTION

This invention relates to golf clubs and more particularly to the construction of the head of a driver type golf club to increase the distance that a golfer is able to drive a golf ball therewith upon taking a full swing of the club.

Golfers are continuously striving to increase the distance of their drives on a golf course. Even a distance of a few yards is very important to a golfer.

In accordance with the present invention, a hollow metal head for a driver is provided with a weight therein which is mounted to move along the path of travel of the head during a normal full swing of the driver. Thus, upon impact of the striking face of the head of the driver, the movable weight is able to provide an additional delayed impact on the ball thereby increasing the distance that the ball can be hit.

One of the objects of the present invention, therefore, is to provide for constructing the head of a driver type golf club with a movable weight therein which acts to increase the distance that a golfer is able to drive a ball.

Another object of the present invention is to provide for constructing a driver type golf club with a hollow metal head having a movable weight therein which as a result of a full swing of the driver adds momentum to the club head to thereby transfer an increased momentum to the ball so that it travels further.

With these and other objects in view, the invention consists of the construction, arrangement and combination of the various parts of the device, whereby the objects contemplated are attained as hereinafter set forth, pointed out in the appended claims and illustrated in the accompanying drawings.

DETAILED DESCRIPTION OF THE PREFERRED EMBODIMENT

Figure 1:
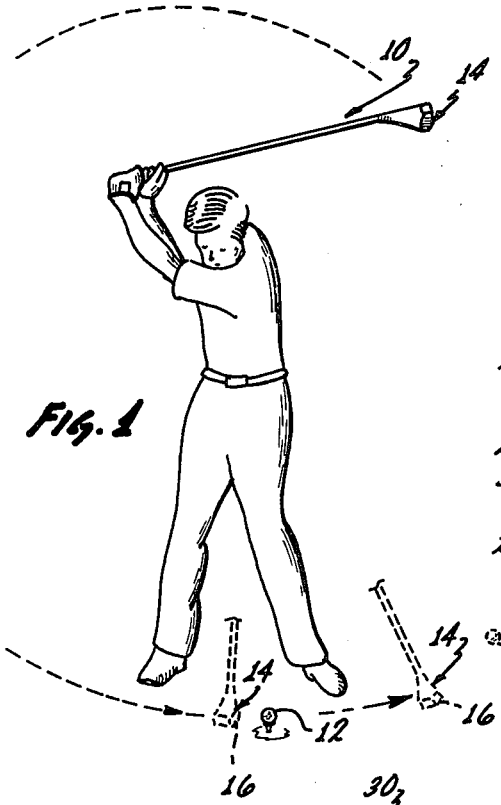
FIG. 1 shows a golfer taking a full swing with a driver to drive a golf ball wherein the driver is provided with a head constructed in accordance with the present invention.

Referring to FIG. 1, a golfer is shown taking a full swing with a golf club 10 of the driver type to drive a golf ball 12. As well understood, when the golf club head 14 strikes the ball 12, a portion of the momentum of the golf club head 14 is transferred to the ball 12 causing it to be driven through the air.

The golf club driver of the present invention includes a hollow head 14 in the form of a metal shell having an outer contour which generally conforms to a head as provided on a conventional driver. It should be particularly noted that the outer flat surface of the front wall of the hollow head 14, which is tilted slightly upwardly, forms the striking face 16. The striking face 16 is thus an integral part of the metal hollow head. The interior of the front wall of the hollow head 14 is provided with a flat vertical surface which is disposed normal to the bottom of the hollow head. The interior of the rear wall of the hollow head 14 is formed with a pair of horizontally spaced vertical flat surfaces 21 which are disposed normal to the bottom of the hollow head. The bottom of the hollow head 14 is covered with a removable sole plate 18 which is seated in a peripheral recess 22. Flat head screws 19 passing through chamfered openings in the sole plate 18 engage threaded holes 23 in the bottom of the head 14.

Figure 5:
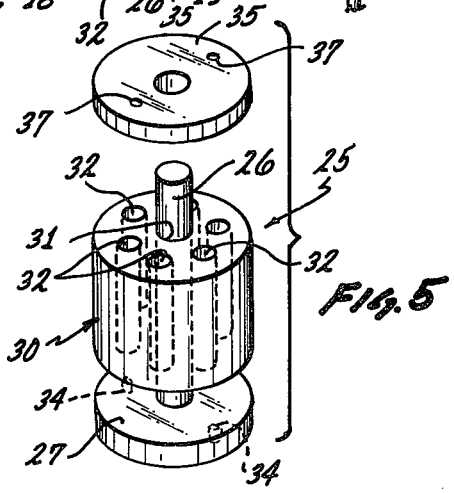
FIG. 5 is an exploded view of the movable weight assembly which is mounted within the golf club head of the present invention.

In accordance with the present invention, with the sole plate 18 removed, an assembly 25, shown in FIG. 5, is inserted within the hollow head 14. The assembly 25 includes a rod 26 preferably having a back circular plate 27 integrally formed on the rear end thereof. Fitted over the free end of the rod 26 so as to have a sliding fit thereon with a minimum of friction is a cylindrical weight 30 which is preferably made of a heavy metal. The weight 30 is provided with a central bore 31 and the outer diameter of the cylindrical weight 30 is equal to or slightly smaller then the back circular plate 27. The body of the cylindrical weight 30 is provided with a plurality of equally spaced holes 32 extending longitudinally therethrough intermediate the outer diameter thereof and the diameter of the central bore 31. A front circular plate 35 which is preferably of the same size as the rear circular plate 27 is provided with a central hole 37 which has a close fit on the free end of the rod 26.

The assembly 25 of the rod 26 with the weight 30 and the front plate 35 positioned on the free end thereof is placed within the opening in the bottom of the hollow head 14 with the rod 26 disposed normal to the interior flat surface 20 of the front wall thereof. The back plate 27 is then positioned up against the spaced vertical flat surfaces 21 and secured by round head screws 28 passing through openings in the rear wall and engaging threaded blind holes 34 in the back circular plate 27. The heads of the screws 28 are seated in recessed openings 29 provided on the outer surface of the rear wall of the head 14. The front plate 35 is then moved along the rod 26 so as to be positioned up against the flat interior front surface 20 of the hollow head 14. The front plate 35 is secured by flat head screws 36 passing through the chamfered openings in the striking face 16 and engaged in threaded blind holes 38 in the front circular plate 35. It should now be clear that the free end of the rod 26 is held in the central hole 37 of the front plate 35 so as to be aligned with the center of the back of the striking face 16.

Once the assembly 25 is secured within the hollow head 14, the sole plate 18 is then replaced in the peripheral recess 22 provided on the bottom thereof and secured by the flat head screws 19.

The operation of the driver type golf club 10 constructed in accordance with the present invention with the movable weight 30 within the hollow head 14 thereof will next be described. After the golf club 10 has been swung back, as shown in FIG. 1, upon starting the downswing, the movable weight 30 within the club head 14 slides back on the rod 26 so as to be positioned against the back plate 27.

Figure 2:
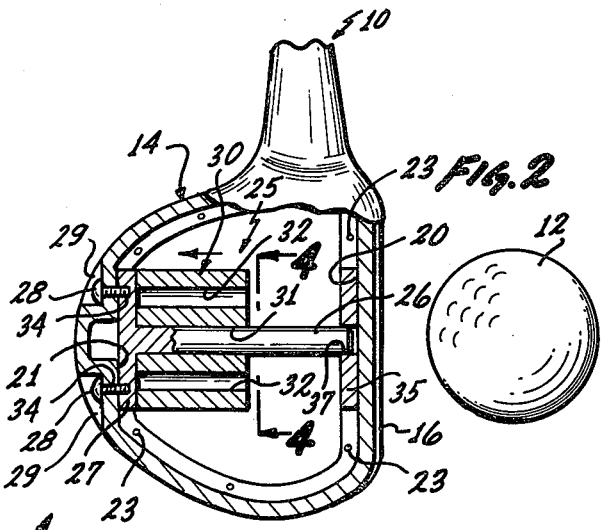
FIG. 2 is a horizontal cross sectional view of the golf club head of the present invention.
Figure 3:
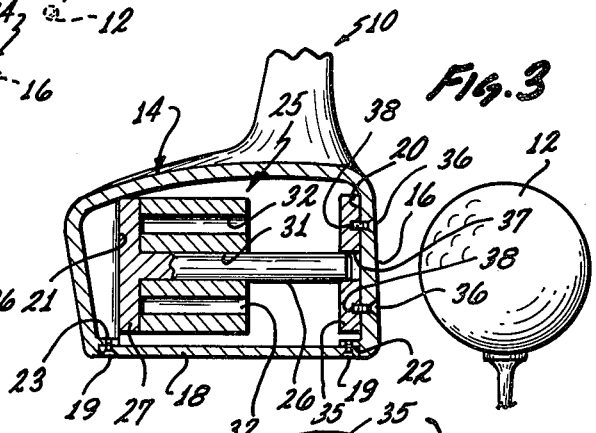
FIG. 3 is a vertical cross sectional view of the golf club head of the present invention.
Figure 4:
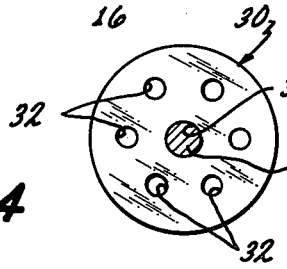
FIG. 4 is a view taken along line 4—4 of FIG. 2.

Thus, as the golf club 10 is swung on its circular path down toward the golf ball 12, up until the instant of impact of the club striking face 16 with the golf ball 12, as shown in FIG. 2, the weight 30 remains in position against the back plate 27. However, upon impact of the striking face 16 with the golf ball 12, the velocity of the club head 14 changes due to the transfer of momentum to the ball, i.e., due to the impulse that the head 14 surrenders when it hits the ball. At that instant, the weight 30 being free to slide on the rod 26, continues to move forward, i.e., is propelled forward, to strike the front plate 35 anchored on the rear of the striking face 16 of the head 14. The velocity of the weight 30 will be proportional to the impact of the head 14 and, therefore, the better the impact, the more effective the impulse with which the weight 30 strikes the ball 12.

It should be particularly noted that the weight 30 moves so as to direct its momentum parallel to the swing of the head 14 and in direct line at the point of impact between the striking face 16 and the ball 12 and balanced on each side thereof. In other words, the effect of the movable weight 30 is to provide for increasing the effective driving force or impulse between the club face 16 and the golf ball 12.

Figure 6:
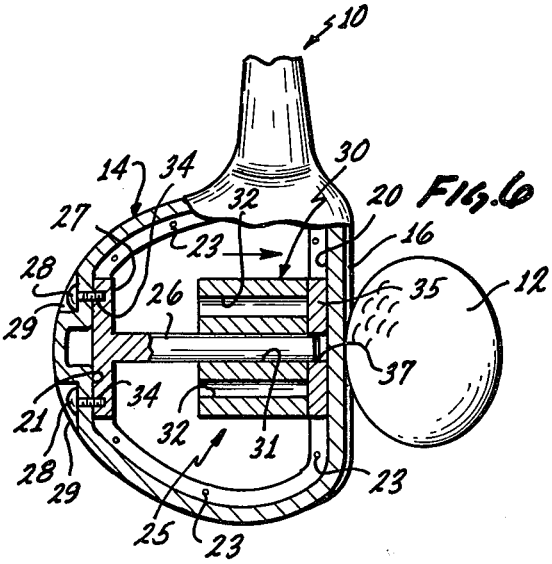
FIG. 6 is a horizontal cross sectional top view of the golf club head similar to FIG. 2 but showing the weight having been moved to strike the front plate upon impact of the face of the golf club head with the golf ball during the full swing of the golf club as shown in FIG. 1.

It should be appreciated that a golf ball 12, upon being properly initially hit by the striking face 16 of the hollow head 14, tends to flatten, i.e., deform as shown in FIG. 6. This action keeps the ball 12 up against the striking face 16 long enough so that it will receive the delayed additional impulse caused by the weight 30 which creates the additional transfer of momentum to the ball. Thus, because of the minute delay between the time it takes for the weight 30 to slide and impact on the striking face 16, the impulse on the ball actually acts for an increased time, which, though relatively minute, increases the affect of the momentum with respect to distance.

As a result, the golf ball 12 experiences an added impulse which results in its travel being increased beyond that provided by the head 14 alone. It is noted that the longitudinal holes 32 in the weight 30 assure that there is no frontal air resistance on the weight 30 within the hollow head that might slow down the velocity with which it strikes the front plate 35.

For example, the momentum with which the golf club head 14 contacts the ball 12 is conventionally equal to its weight times its velocity. However, with the club head of the present invention, the affect of the movable weight 30 is to provide an additional momentum with which the club head 14 contacts the ball 12 which is equal to the movable weight 30 times its velocity. Typically the movable weight 30 is on the order of one to two ounces. This added momentum is effective to produce an increased distance of travel for the golf ball on the order of 15 to 20 yards depending on the efficiency with which the striking face of the hollow head 14 initially impacts against the golf ball.

While the preferred embodiment of the golf club head described herein is well adapted to fulfill the objects and advantages previously mentioned as desirable, it is to be understood that the invention is not limited to the specific features shown and described but that the means and configuration herein disclosed are susceptible of modification in form, proportion and arrangement of parts without departing from the principle involved or sacrificing any of its advantages and the invention is therefore claimed in embodiments of various forms all coming within the scope of the claims which follow.

What is claimed is:

1. A golf club of the driver type comprising:

a hollow metal head having integrally formed thereon a front striking face and a rear wall having interior flat portions thereon;

a removable sole plate for said hollow metal head;

a rod having a back plate integrally formed thereon;

a cylindrical weight having a central bore by which it is mounted on said rod so as to have free sliding movement thereon;

a front plate having an opening for receiving the front end of said rod;

said rod being fixed in position within said hollow head with its back plate anchored against the interior flat portions on the rear wall thereof and with the front plate on the front end thereof anchored against the back of said striking face;

whereby when a golfer takes a full swing with the golf club to drive a ball, said weight freely slides on said rod so as to be positioned against the back plate integrally formed on the rear end thereof and upon impact of the striking face of the club head with the ball said weight is propelled to freely slide on said rod to hit the front plate anchored on the back of the striking face to provide an additional impact upon the ball thereby increasing the distance the ball travels.

2. A golf club of the driver type as defined in claim 1 wherein said cylindrical weight has equally spaced longitudinal opening therein surrounding its central bore.

* * * * *